US009010960B2

(12) United States Patent
Kamm

(10) Patent No.: US 9,010,960 B2
(45) Date of Patent: Apr. 21, 2015

(54) FLASHLIGHT HAVING ROLLING PROTECTION

(71) Applicant: Dieter Rix, Coesfeld (DE)

(72) Inventor: Benjamin Kamm, Wiesbaden (DE)

(73) Assignee: Dieter Rix, Coesfeld (DE)

( * ) Notice: Subject to any disclaimer, the term of this patent is extended or adjusted under 35 U.S.C. 154(b) by 0 days.

(21) Appl. No.: 14/354,967

(22) PCT Filed: Nov. 8, 2012

(86) PCT No.: PCT/EP2012/072111

§ 371 (c)(1),
(2) Date: Apr. 29, 2014

(87) PCT Pub. No.: WO2013/068446

PCT Pub. Date: May 16, 2013

(65) Prior Publication Data

US 2014/0268712 A1 Sep. 18, 2014

(30) Foreign Application Priority Data

Nov. 8, 2011 (DE) ..... 10 2011 085 916

(51) Int. Cl.

| | |
|---|---|
| ***F21L 4/00*** | (2006.01) |
| ***F21V 15/01*** | (2006.01) |
| ***F21V 21/08*** | (2006.01) |
| *F21W 131/40* | (2006.01) |

(52) U.S. Cl.

CPC . *F21L 4/00* (2013.01); *F21L 4/005* (2013.01); *F21V 15/01* (2013.01); *F21W 2131/40* (2013.01); *F21V 21/08* (2013.01)

(58) Field of Classification Search

USPC ..... 362/190, 191, 202, 205, 206

See application file for complete search history.

(56) References Cited

U.S. PATENT DOCUMENTS

| | | | | |
|---|---|---|---|---|
| 1,211,465 | A | 1/1917 | McGuckin | |
| 1,447,050 | A | 2/1923 | Stimson | |
| 2,040,423 | A * | 5/1936 | Barber et al. | 362/208 |
| 5,339,229 | A | 8/1994 | Snyder | |
| 5,957,567 | A | 9/1999 | Kish et al. | |
| 6,158,874 | A | 12/2000 | Brustein et al. | |
| 6,183,105 | B1 | 2/2001 | Parker | |
| 7,604,371 | B2 * | 10/2009 | Bushee et al. | 362/206 |
| 7,905,624 | B2 | 3/2011 | Bushee et al. | |
| 7,997,755 | B2 * | 8/2011 | Liao et al. | 362/202 |
| 2003/0202345 | A1 * | 10/2003 | Kim | 362/190 |
| 2006/0256553 | A1 | 11/2006 | Lin | |
| 2007/0195521 | A1 | 8/2007 | Rosiello | |
| 2008/0291667 | A1 | 11/2008 | Bushee et al. | |
| 2011/0176294 | A1 | 7/2011 | Kim | |
| 2012/0275143 | A1 * | 11/2012 | Robinson et al. | 362/184 |

* cited by examiner

*Primary Examiner* — Laura Tso

(74) *Attorney, Agent, or Firm* — Hudak, Shunk & Farine Co. LPA

(57) ABSTRACT

A flashlight having integrated rolling protection, including a rod-shaped housing, at the first end of which a light body is arranged and at the opposite, second end of which a cap is arranged, wherein the light body has a light outlet opening and a circumferential wall having a rounded outer contour, which circumferential wall surrounds the light outlet opening, and the circumferential wall is designed as having at least one rolling protection surface that cuts the cross-section of the circumferential wall in the manner of a secant. The aim is to provide a flashlight having effective and captive rolling protection. Said aim is achieved by a flashlight for which a support ring raised relative to the rod-shaped housing is formed on the second end or the cap, the outer contour of said support ring lying in a common plane with the at least one rolling protection surface.

17 Claims, 2 Drawing Sheets

FLASHLIGHT HAVING ROLLING PROTECTION

FIELD OF THE INVENTION

The invention relates to a flashlight having integrated rolling protection, comprising a rod-shaped housing, at the first end of which a light body is arranged and at the opposite, second end of which a cap is arranged, wherein the light body has a light outlet opening and a circumferential wall having a rounded outer contour, and the circumferential wall is designed as having at least one rolling protection surface that cuts the cross-section of the circumferential wall in the manner of a secant.

BACKGROUND OF THE INVENTION

Such flashlights are used in professional applications and also known as so-called "tactical flashlights". Due to the particularly stable design, the flashlights can also be used as a bludgeon against persons or for breaking panes of glass. Since the housing of the flashlights essentially has a round cross section or is characterized by a rounded outer contour, the lamps have a tendency to roll when set down on an uneven or unsteady surface, which is especially disadvantageous when the user of the flashlight needs the light for working with a tool of weapon with both hands, for example, and the cone of light no longer strikes the (work) surface being illuminated.

For this reason, there have already been efforts in the past to provide the flashlights with an adaptable rolling protection. U.S. Pat. No. 5,339,229 calls for shoving onto the rod-shaped housing a cylindrical ring with five or six rolling protection surfaces uniformly distributed on its outside. The cylindrical ring is supposed to be frictionally locked and also magnetically secured to the rod-shaped housing, insofar as a ferromagnetic flashlight is used.

In practice, however, it has been found that a removable rolling protection often gets lost under the frequently harsh conditions of use and is no longer available for use.

A fundamental prior art is disclosed by U.S. Pat. No. 6,158,874 with a flashlight that has a rod-shaped housing and a bulb-shaped light body at its front end. The light body has a ring that is concentric and axially parallel to the rod-shaped housing, with a plurality of planar rolling protection surfaces directly adjoining each other in the circumferential direction. The main drawback of this known flashlight is that when the flashlight is set down on a surface it takes up a position that is slanted relative to the surface, due to the end of the rod shaped housing away from the light body having a smaller diameter, and the rear end is tilted downward. This, in turn, means that the rolling protection surfaces are not effectively in contact with the surface, or only slightly so, and the desired rolling protection is not accomplished to the needed extent. Another major drawback is that the cone of light when the flashlight is set down is no longer emitted axially parallel from the light body, but instead shines upward at a slant.

SUMMARY OF THE INVENTION

For these reasons, the problem of the invention was to provide a flashlight with an effective and captive rolling protection.

The problem is solved according to the invention with a flashlight in which a support ring is formed at the second end or the cap that is raised above the rod-shaped housing, whose outer contour lies in a common plane with at least one rolling protection surface.

This arrangement of support ring and rolling protection surface produces a defined two-part standing surface at opposite ends of the flashlight, and when the support ring is properly dimensioned the rolling protection surface preserves a full-area contact with the surface on which it is placed.

The feature of a rolling protection surface and the dimensioning of the outer contour of the support ring lead to the synergistic effect that one of the rolling protection surfaces is always kept in full-area contact with the surface on which it is placed. Since the rolling protection surface cuts the cross section in the manner of a secant at right angle to the axial dimension of the housing, there is already an at least linear contact with the surface in this spatial direction. In the direction of the axial dimension of the housing, the support ring raises the second end so that the linear contacting turns into a two-dimensional contacting of the rolling protection surface on the surface on which it is placed.

The flashlight according to the invention thanks to the rolling protection surface lying on the full area affords an especially effective rolling protection, which is especially relevant when the flashlight is set down parallel or at a slant to a table edge, the corner of a step, or a beaded roof edge/engine hood and the user needs to have both hands free for other activities. In these situations it is absolutely essential for the flashlight to remain in its defined position of placement, and the rolling protection surface even allows some overhanging of the flashlight beyond the table edge, the corner of the step, etc. In this regard, a rolling protection also includes a tilting protection.

As regards rolling safety, the width of the rolling protection surface cut out as a secant from the circular circumferential wall in the transverse direction is the main factor. A maximum safety against rolling away would be provided by a secant angle of 180°, that is, a horizontal section through the light body. But such a technical configuration is not possible, simply because the secant angle can only be maximized so much before reaching the smaller diameter of the rod-shaped housing. According to the invention, the secant angle should lie in a range between 50° to 90°, especially preferably 65° to 75°, subtended by the two points of intersection of rolling protection surface with the circumferential wall at the center point and in the longitudinal axis of the flashlight, respectively.

Insofar as the cone of light from the flashlight laid down should emerge from the light outlet opening in the forward extension of the longitudinal axis, the rolling protection surfaces must be oriented with its surface parallel to the longitudinal axis of the rod-shaped housing. Both the rolling protection surface is configured axially parallel to the longitudinal axis of the flashlight and the rolling protection surface is axially parallel to the abutment on the support ring. Thus, the support ring has at least one apex point which corresponds to the perpendicular distance of the rolling protection surface from the longitudinal axis in regard to its radius.

By the term "front" for the flashlight is meant the end of the light body and by the term "rear" is meant the end of the cap.

The support ring is an integral part of the rod-shaped housing or the cap. Since the support ring is raised relative to the rod-shaped housing, that is, it is provided with a larger outer diameter, the flashlight can also be grasped from the rear, in which case the index and middle finger are placed on opposite sides of the rod-shaped housing. With the thumb pressing at the same time against the rear end away from the light body, the support ring prevents the flashlight from slipping out between index and middle finger to the front. This grasping technique enables a form-fitting fixation of the flashlight with one hand of the user.

In the circumferential direction preferably three uniformly spaced rolling protection surfaces can be provided. When the flashlight is set down on a surface, it lies on one of the rolling protection surfaces, while the other two rolling protection surfaces are slanting upward and conspicuous, being especially suitable for the imprinting or engraving of information. Besides the name or service unit/location, there can also be the name of an advertiser, if the flashlight is handed out as an advertising means.

The support ring is arranged at a distance in the axial direction of the flashlight from the at least one rolling protection surface, and preferably a grip surface is arranged between the at least one rolling protection surface and the support ring.

Advantageously, the circumferential wall is configured with at least one wall segment tapering in conical manner to the front in the axial direction. A conical configuration of the front light body facilitates the inserting of the flashlight into a specially provided holster, which is often worn by professional users for transporting the flashlight close to their body.

The at least one rolling protection surface can then be configured at least partly in the conically tapering wall segment.

Preferably several rolling protection surfaces are provided, spaced apart in the circumferential direction, there being always arranged between two neighboring rolling protection surfaces a segment of the otherwise cylindrical or conically configured circumferential wall. In this way, the flashlight can be grasped especially easily on its light body. Insofar as a holster is used, the flashlight can be inserted into it especially smoothly and without jamming.

According to a first especially preferred embodiment, the support ring has a cylindrical outer diameter, and the cylindrical outer diameter in the axial direction of the rod-shaped housing is flush with the rolling protection surface. The rear support surface of the flashlight laid down is thus formed from the circular support ring, producing a linear contact region with the surface on which it is placed. Besides an easier manufacture, the flashlight then has only round contours in the region of its rod-shaped housing, which usually serves at the same time as a grip surface, so that an especially convenient carrying of the flashlight for a lengthy period of time is possible. Furthermore, this avoids projecting pieces of the housing, which might hinder the inserting of the flashlight into a bag or holster, for example.

According to a second alternative embodiment, the support ring has at least one flat support surface, and the support surface(s) in the axial direction are flush with the rolling protection surface. Consequently, in this configuration, the support ring has a distinctly larger diameter than in the first configuration, since the support surfaces need to be worked out from the outer circumference. A suitable outer diameter of the support ring is approximately the maximum outer diameter of the light body. The diameter of the support ring is directly correlated with the desired size of the support surface(s), with a larger outer diameter leading to a likewise large support surface and vice versa.

Advisedly, the light outlet opening is surrounded by wall projections of the circumferential wall sticking out in the axial direction of the rod-shaped housing. The wall projections make it possible, for example, to break panes of glass without the diffusing glass plate located on the light body or the lamp arranged behind it getting damaged. If the light body is provided with wall projections, a conically tapering circumferential wall should also be provided, for otherwise the flashlight could only be inserted with great effort into the narrow holster.

Advantageously, the at least one rolling protection surface reaches into one of the wall projections. An especially balanced weight distribution and an excellent grasping of the flashlight can be achieved when each of the rolling protection surfaces reaches into the corresponding wall projection lying in front of it in the axial direction. This furthermore results in a decreasing of the wall thickness in the region of the wall projections, producing an especially sharp front edge, which can be used effectively as a striking weapon or for breaking even thick panes of glass.

Between neighboring wall projections there can be provided a recess, the recess being formed as a circular cutout with constant radius. This results in a crown like structure of the front light body, which ensures an increased surface pressure in the area of the wall projections upon striking a surface. The constant radius in the region of the recesses lessens the tendency to get stuck on garments or belts.

Preferably, the cap has three standing elements at its end away from the light body, being distributed in the circumferential direction and set back in the axial direction. The standing elements are each configured identically and form a wobble-free standing surface perpendicular to the axial dimension of the flashlight. Therefore the flashlight in this embodiment can not only be set down safe against rolling, but also stand up securely.

Advisedly, the standing elements surround a centrally arranged activating button in the manner of a crown and extend beyond it backward in the axial direction. This prevents an accidental switching of the flashlight on or off when in the upright position.

BRIEF DESCRIPTION OF THE DRAWINGS

For a better understanding, the invention is explained more closely below by means of five figures. There are shown

DETAILED DESCRIPTION OF THE INVENTION

Figure 1:
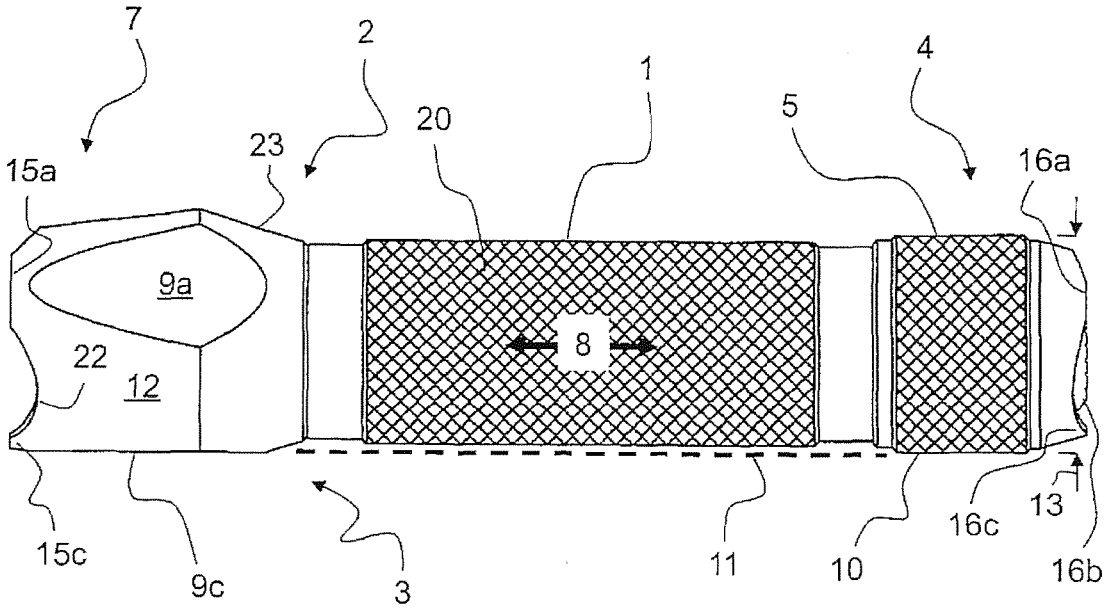
FIG. 1: a side view of a flashlight according to the invention in a first embodiment.

FIG. 1 shows a side view of a flashlight according to a first preferred embodiment. The flashlight consists of a rod-shaped housing 1, at whose front end 2 there is a light body 3. At the rear end 4, the rod-shaped housing 1 is closed by a cap 5. The cap 5 is preferably connected in detachable manner by a threaded connection to the rod-shaped housing 1 and thus closes off the rod-shaped housing 1 in its longitudinal axis 8 at the rear. In the rod-shaped housing 1 there is a battery compartment for the electric power supply of the flashlight. The outer surface of the rod-shaped housing 1 is provided with a knurling as a grip surface 20.

Figure 2:
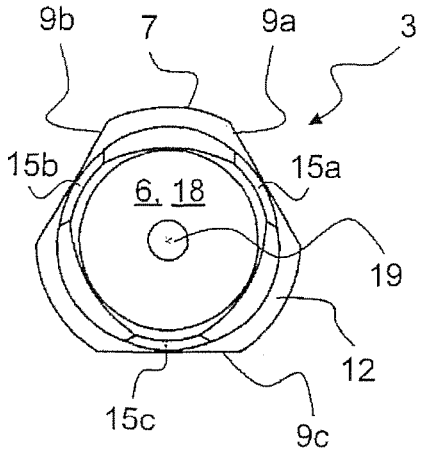
FIG. 2: a front view of the flashlight of FIG. 1.

The light body 3 has a circumferential wall 7 with a pot-shaped connecting area 23 to the rod-shaped housing 1 and adjoining this in front a conically tapering wall segment 12. The conically tapering front wall segment 12 surrounds a light outlet opening 6, which is closed by a diffusing glass plate 18 (see FIG. 2) oriented orthogonally to the longitudinal axis 8.

The light body 3 formed as a conical cylinder, and therefore also as a double conical cylinder, is cut on three sides so that three rolling protection surfaces 9*a*, 9*b*, 9*c* are formed, uniformly distributed in the circumferential direction, the side view of FIG. 1 showing only the rolling protection surface 9*c* serving as a base and the rolling protection surface 9*a* which is slanting upward in the plane of the drawing.

The desirable full-area contact between one of the rolling protection surfaces 9*a*, 9*b*, 9*c* and the base surface comes about in that the cap 5 located at the rear end 4 is formed with a support ring 10. The support ring 10 is a bulge of larger diameter than the rod-shaped housing 1, whose outer diameter 3 is dimensioned such that the rear end 4 is raised and the particular rolling protection surface 9*a*, 9*b*, 9*c* lies by its full area on the support base. The rolling protection surface 9*c* and the outer diameter 13 of the support ring 10 form a common plane 11 here.

As is especially well seen by means of the rolling protection surface 9*c*, the rolling protection surfaces 9*a*, 9*b*, 9*c* are oriented parallel to the longitudinal axis 8 of the flashlight or the rod-shaped housing 1, so that the light cone emitted from the light outlet opening 6 emerges with its axis parallel to the support base. Basically, the rolling protection surfaces 9*a*, 9*b*, 9*c* can also be tilted to the longitudinal axis 8, so that the support ring 10 would need to have a correspondingly larger or smaller outer diameter 13 for a full-area contact with the support base. In this case, the axis of the light cone would not be oriented parallel to the support base.

The conical wall segment 12 as a prolongation of the rolling protection surfaces 9*a*, 9*b*, 9*c* passes into wall projections 15*a*, 15*b*, 15*c*. The wall projections 15*a*, 5*b*, 15*c* are separated from each other by the recesses 22 located in between. The recesses 22 have a preferably semicircular shape. As is especially well seen in FIG. 2, the wall projections 15*a*, 15*b*, 15*c* are arranged concentrically around a lamp 19.

Figure 3:
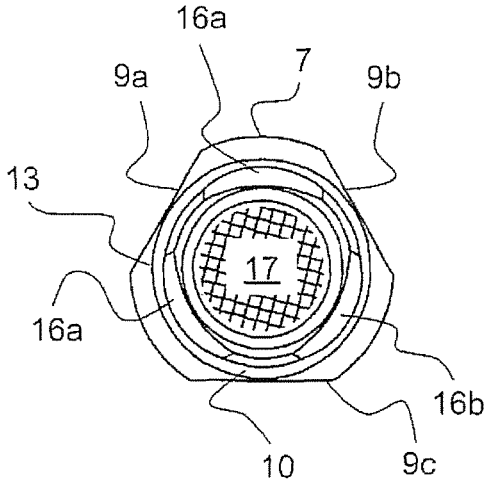
FIG. 3: a rear view of the flashlight of FIG. 1.

The rear view of FIG. 3 illustrates the circular outer diameter 13 of the support ring 10 reaching directly to the rolling protection surfaces 9*a*, 9*b*, 9*c*. Furthermore, backward extending standing elements 16*a*, 16*b*, 16*c* are formed on the cap 5. The standing elements 16*a*, 16*b*, 16*c* are uniformly distributed in the circumferential direction and surround an activating button 17 which is set back inside them and which enables in particular a switching of the flashlight on and off.

Figure 4:
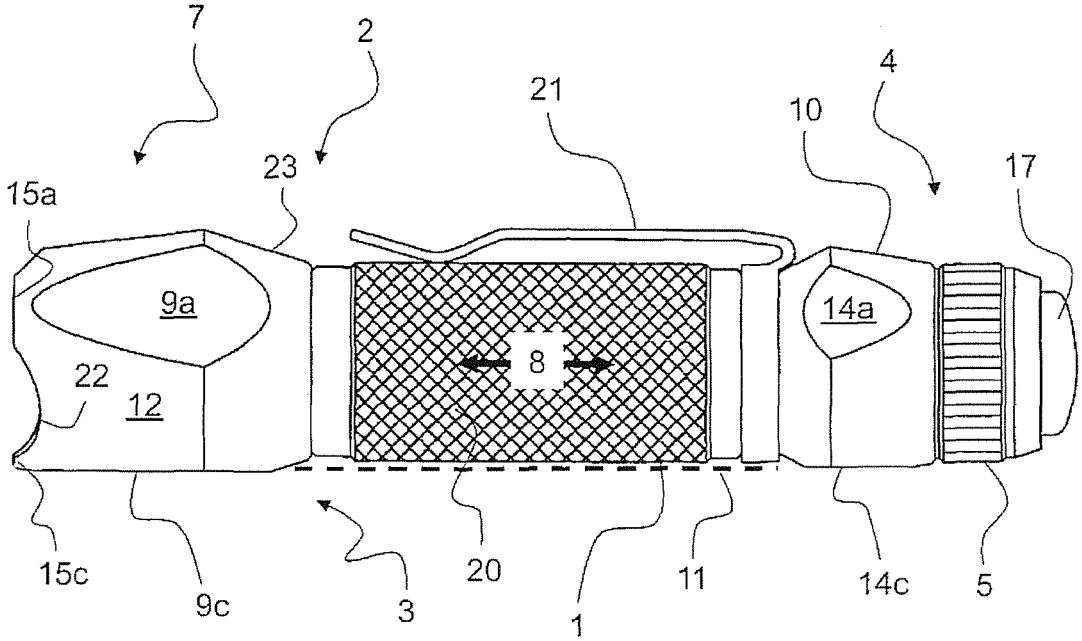
FIG. 4: a side view of a flashlight according to the invention in a second embodiment
Figure 5:
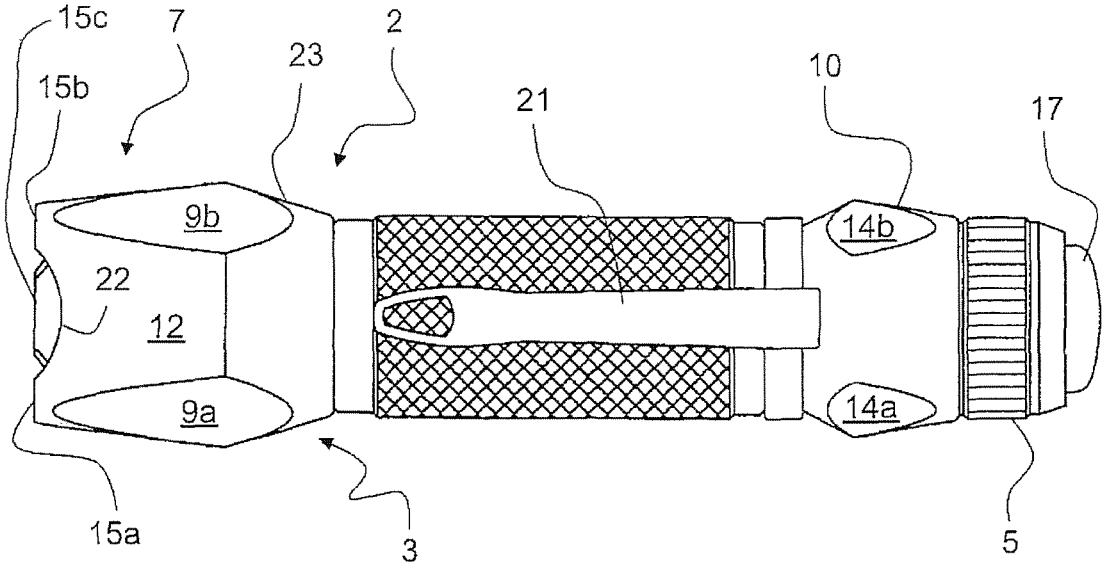
FIG. 5: a top view of the flashlight of FIG. 4.

FIGS. 4 and 5 show a modified embodiment in which the support ring 10 is arranged not on the cap 5, but on the rear end 4 of the rod-shaped housing 1. The support ring 10 here is an integral part of the rod-shaped housing 1 and not the cap 5.

Furthermore, a total of three flat support surfaces 14*a*, 14*b*, 14*c* are formed on the support ring 10, uniformly distributed in the circumferential direction. Each of the support surfaces 14*a*, 14*b*, 14*c* is flush with a corresponding rolling protection surface 9*a*, 9*b*, 9*c* on the light body 3, so that for example the rolling protection surface 9*c* and the support surface 14*c* are situated in a common plane 11.

With the aid of a fastening clip 21 the flashlight can be secured to a garment, for example.

LIST OF REFERENCE NUMBERS

1 Rod-shaped housing
2 First end/front end
3 Light body
4 Second end/rear end
5 Cap
6 Light outlet opening
7 Circumferential wall
8 Longitudinal axis
9*a-c* Rolling protection surface
10 Support ring
11 Common plane
12 Conical wall segment
13 Outer diameter support ring
14*a-c* Flat support surface
15*a-c* Wall projection
16*a-c* Standing element
17 Activating button
18 Diffusing glass plate
19 Lamp
20 Grip surface
21 Fastening clip
22 Recess
23 Connecting area

What is claimed is:

1. A flashlight having integrated rolling protection, comprising: a rod-shaped housing (1), at a first end of which a light body is arranged and at an opposite, second end of which a cap is arranged, wherein the light body has a light outlet opening and a circumferential wall having a rounded outer contour, and the circumferential wall is designed as having at least one rolling protection surface that cuts a cross-section of the circumferential wall in the manner of a secant, wherein a support ring raised relative to the rod-shaped housing is formed on the second end or the cap, the outer contour of said support ring lying in a common plane with the at least one rolling protection surface.

2. The flashlight according to claim 1, wherein the circumferential wall is formed with at least one wall segment tapering conically to the front in the axial direction.

3. The flashlight according to claim 2, wherein the at least one rolling protection surface is formed at least partly in the conically tapering wall segment.

4. The flashlight according to claim 1, wherein several rolling protection surfaces are provided, spaced apart in the circumferential direction, and a segment of the circumferential wall is always arranged between two neighboring rolling protection surfaces.

5. The flashlight according to claim 1, wherein the support ring has a cylindrical outer diameter, and the cylindrical outer diameter in the axial direction of the rod-shaped housing is flush with the rolling protection surface.

6. The flashlight according to claim 1, wherein the support ring has at least one flat support surface, and the support surface(s) are flush with the rolling protection surface(s) in the axial direction.

7. The flashlight according to claim 1, wherein the light outlet opening is surrounded by wall projections of the circumferential wall which stick out in the axial direction of the rod-shaped housing.

8. The flashlight according to claim 7, wherein the at least one rolling protection surface reaches into one of the wall projections.

9. The flashlight according to claim 1, wherein the cap has at its rear end three standing elements that are distributed in the circumferential direction and set back in the axial direction.

10. The flashlight according to claim 9, wherein the standing elements surround a centrally arranged activating button like a crown and extend beyond it in the axial direction to the rear.

11. The flashlight according to claim 3, wherein several rolling protection surfaces are provided, spaced apart in the circumferential direction, and a segment of the circumferential wall is always arranged between two neighboring rolling protection surfaces.

12. The flashlight according to claim 11, wherein the support ring has a cylindrical outer diameter, and the cylindrical outer diameter in the axial direction of the rod-shaped housing is flush with the rolling protection surface.

13. The flashlight according to claim 11, wherein the support ring has at least one flat support surface, and the support surface(s) are flush with the rolling protection surface(s) in the axial direction.

14. The flashlight according to claim 13, wherein the light outlet opening is surrounded by wall projections of the circumferential wall which stick out in the axial direction of the rod-shaped housing.

15. The flashlight according to claim 14, wherein the at least one rolling protection surface reaches into one of the wall projections.

16. The flashlight according to claim 15, wherein the cap has at its rear end three standing elements that are distributed in the circumferential direction and set back in the axial direction.

17. The flashlight according to claim 16, wherein the standing elements surround a centrally arranged activating button like a crown and extend beyond it in the axial direction to the rear.

* * * * *